US011939655B2

(12) United States Patent
Philippe et al.

(10) Patent No.: US 11,939,655 B2
(45) Date of Patent: Mar. 26, 2024

(54) ALUMINIUM ALLOY BLANKS WITH LOCAL FLASH ANNEALING

(71) Applicant: CONSTELLIUM NEUF-BRISACH, Biesheim (FR)

(72) Inventors: Sabine Philippe, Entre-Deux-Guiers (FR); Jack Franklin, Plymouth, MI (US)

(73) Assignee: CONSTELLIUM NEUF-BRISACH, Biesheim (FR)

( * ) Notice: Subject to any disclaimer, the term of this patent is extended or adjusted under 35 U.S.C. 154(b) by 643 days.

(21) Appl. No.: 16/316,660

(22) PCT Filed: Jul. 7, 2017

(86) PCT No.: PCT/EP2017/067055
§ 371 (c)(1),
(2) Date: Jan. 10, 2019

(87) PCT Pub. No.: WO2018/011069
PCT Pub. Date: Jan. 18, 2018

(65) Prior Publication Data

US 2019/0226071 A1 Jul. 25, 2019

(30) Foreign Application Priority Data

Jul. 13, 2016 (FR) ..... 1656780

(51) Int. Cl.
*C22F 1/05* (2006.01)
*C22C 21/08* (2006.01)

(52) U.S. Cl.
CPC ..... *C22F 1/05* (2013.01); *C22C 21/08* (2013.01)

(58) Field of Classification Search
CPC ..... C21D 8/0294; C21D 2221/00; C21D 2221/01–2221/10; C21D 2221/02;
(Continued)

(56) References Cited

U.S. PATENT DOCUMENTS 5,549,768 A * 8/1996 Mahoney ..... C21D 7/04 148/695
6,033,499 A * 3/2000 Mitra ..... B21D 11/18 148/688

(Continued)

FOREIGN PATENT DOCUMENTS

DE 102006025522 A1 * 12/2007 ..... B21D 51/10
DE 102009031449 A1 3/2010

(Continued)

OTHER PUBLICATIONS

Hofmann et al., "Deep drawing of process optimized blanks", 2001. Journal of Materials Processing Technology, vol. 119, pp. 127-132 (Year: 2001).*

(Continued)

*Primary Examiner* — John A Hevey
(74) *Attorney, Agent, or Firm* — McBee Moore & Vanik IP, LLC

(57) ABSTRACT

The invention concerns a method for improving aluminium alloy blank tensile yield stress and formability comprising the successive steps of: providing a 6xxx series aluminium alloy slab; optionally homogenizing the slab; hot rolling and optionally cold rolling the slab to obtain a sheet; solution heat treating and quenching the sheet; cold rolling the sheet with at least 20% cold work reduction; cutting the sheet into blanks; flash annealing a portion of the flange of the blanks at a temperature between 360° C. and 480° C. for a time sufficient to obtain recrystallization of the portion of the flange and cool to a temperature of less than 100° C. The improved blanks and the stamped product and painted stamped products obtained by the method of the invention are particularly useful for automotive applications because of their high strength.

19 Claims, 6 Drawing Sheets

(58) Field of Classification Search
CPC .. C22F 1/04–1/057; C22F 1/05; B21D 22/02; B21D 22/20; B21D 53/88; C22C 21/00–18; C22C 21/08
See application file for complete search history.

(56) References Cited

U.S. PATENT DOCUMENTS

| | | | | |
|---|---|---|---|---|
| 2009/0148721 | A1* | 6/2009 | Hibino | C22C 21/02 428/650 |
| 2009/0196784 | A1* | 8/2009 | Fedchun | C22C 38/44 420/61 |
| 2014/0366997 | A1* | 12/2014 | Kamat | C22C 21/00 148/551 |

FOREIGN PATENT DOCUMENTS

| | | | | |
|---|---|---|---|---|
| DE | 102013013359 | A1 | | 4/2014 |
| EP | 1601478 | A1 | | 12/2005 |
| JP | 2004124151 | A | * | 4/2004 |
| JP | 2006205244 | A | * | 8/2006 |
| JP | 2008266684 | A | * | 11/2008 |
| JP | 2009241856 | A | * | 10/2009 |
| JP | 2009242905 | A | * | 10/2009 |
| JP | 2009242907 | A | * | 10/2009 |
| JP | 2010227954 | A | * | 10/2010 |
| JP | 2010227954 | A | | 10/2010 |

OTHER PUBLICATIONS

International Search Report received from corresponding PCT/EP2017/067055, dated Oct. 2, 2017.

American National Standard Alloy and Temper Designation Systems for Aluminum, American National Standards Institute, Arlington VA [ANSI H35.1/H35.1(M)-2013] (Nov. 7, 2013).

Hatch (ED), "Metallurgy of Heat Treatment and General Principles of Precipitation Hardening," Aluminum Properties and Physical Metallurgy, Chapter 5, pp. 134-199 (1984).

* cited by examiner

ALUMINIUM ALLOY BLANKS WITH LOCAL FLASH ANNEALING

CROSS REFERENCE TO RELATED APPLICATIONS

This application is a National Stage entry of International Application No. PCT/EP2017/067055 filed 7 Jul. 2017, which claims priority to French Patent Application No. 16/56780, filed 13 Jul. 2016.

BACKGROUND

Field of the Invention

The present invention relates to property tailored blank aluminium alloys suitable for the automotive industry.

Description of Related Art

Various aluminium alloys are used in the form of sheets or blanks for automotive usages. Among these alloys, AA6xxx aluminium alloys series, such as AA6016-T4 are known to combine interesting chemical and mechanical properties such as hardness, strength, and even corrosion resistance. These properties generally make AA6xxx aluminium alloys a material of choice in the automotive industry. In order to improve the mechanical strength of AA6XXX alloys, it was proposed, for example in WO2012/033954 to cold work the sheets by at least 25% after solution heat treatment and then thermally treating. However, cold worked AA6xxx are known to be less formable than in the T4 temper. Alternative materials are AA5xxx aluminium alloys, such as the AA5182-0 and the AA5754-0, which provide a good balance of mechanical resistance and formability.

However, AA5xxx alloys have lower mechanical specifications than AA6xxx alloys after paint-bake treatment.

The mechanical properties are homogeneous within the 6xxx aluminium alloy sheets or blanks whereas the part formed from this blank is submitted locally to various constraints. Thus, the part must be over-designed in some areas in order to accommodate to the minimum requirements to obtain the targeted performance values.

Some attempts have been made in the past to improve the formability of aluminium alloys.

It is known from German patent application DE 10 2009 031 449 A1 a method for forming an aluminium sheet comprising the steps of locally heating an aluminium sheet. This method also requires the thermoforming of the aluminium sheet. German patent application DE 10 2013 013 359 A1 also describes a method of forming an aluminium sheet comprising the steps of locally heating an aluminium sheet at 250-325° C., and cold forming the aluminium sheet. However, the thermal treatment temperature is too low to improve the formability of the aluminium sheets or blanks.

It is known from European patent EP 2 554 288 B1 a method for the thermal treatment of aluminium sheet material comprising the steps of providing an aluminium sheet material, heating the aluminium sheet material to a temperature (I) greater than or equal to a heating temperature, maintaining said temperature (I) over a heating period, quenching at least one quenching area of the aluminium sheet material to a temperature (I) lower or equal to the quenching temperature within a quenching period, cooling at least one area of the aluminium sheet material to a temperature (T) lower or equal to a cooling temperature, wherein the cooling is performed within a cooling period greater than the quenching period and protecting the cooling area by a tool during quenching.

This method has the disadvantage of being difficult to industrialize and requires additional steps and equipment for heating the whole aluminium sheet and covering and protecting the cooling area of the aluminium sheet material during quenching.

It is known from international patent application WO 97/44147 A1 a method of forming an aluminium alloy piece by heat-treating in the region that is being shaped. However, such method requires an heating source such as a laser beam and also requires the aluminium alloy piece to be formed a short time after the heat treating step occurs, i.e. approximately 12 hours after the heat treating step.

It is also known from U.S. Pat. No. 8,211,251 B2 the local heat-treating of aluminium panels to increase local yield strength ranges from 150 to 300 MPa. However, this method is not suitable to improve both the yield strength ranges and the formability of aluminium alloy sheets.

European Patent EP 1 601 478 B1 describes a process for manufacturing drawn parts made of an aluminium alloy comprising the steps of:

manufacturing a strip with a thickness of 0.5 to 5 mm of an alloy composition of 1-6 wt. % of Mg, less than 1.2 wt. % of Mn, less than 1 wt. % of Cu, less than 1 wt. % of Zn, less than 3 wt. % of Si, less than 2 wt. % of Fe, less than 0.4 wt. % of Cr, less than 0.3 wt. % of Zr, less than 0.1 wt. % of each other elements and 0.5 wt. % in total, the remainder being Al; cutting a blank from the strip; local or complete heating of the blank to a temperature of 150 to 350° C. for a duration of 30 seconds or less; drawing of the heated blank using a tool heated to a temperature of 150 to 350° C. in the presence of a lubricant compatible with subsequent operation.

However, the method of EP 1 601 478 B1 is difficult to industrialize as it requires the drawing or stamping tool to be heated at a temperature ranging from 150 to 350° C.

It is also known from patents and patent applications such as EP 2 075 348 B1, JP 2011-115837 A1, JP 2013-023747 A1, JP 2013-010998 A1, JP 2010-22795 Al various methods of processing aluminium alloys however these methods operate at a moderate heating temperature which does not provide sufficient formability.

There is thus a need in the automotive industry for 6xxx series aluminium alloys blanks, which combine high tensile yield strength and good formability properties suitable for cold stamping operations.

SUMMARY

The inventors have obtained such aluminium alloy blanks combining both high tensile yield stress and formability by a method comprising the successive steps of:

a) providing a 6xxx series aluminium alloy slab;
b) optionally homogenizing said slab;
c) hot rolling and optionally cold rolling the slab to obtain a sheet;
d) solution heat treating and quenching said sheet;
e) cold rolling said sheet with at least 20% cold work reduction;
f) cutting said sheet into blanks;
g) flash annealing a portion of the flange of said blanks at a temperature between 360° C. and 480° C. for a time sufficient to obtain recrystallization of said portion of the flange and cool to a temperature of less than 100° C.

According to the invention, stamped aluminium alloy products are obtained by:

placing the flange of a blank according to the invention within the blank holder of a press;

stamping said blank to obtain a rough stamped product;

removing the flange from said rough stamped product.

The stamped aluminium alloy products according to the invention are useful for automotive applications.

DETAILED DESCRIPTION OF A PREFERRED EMBODIMENT

Figure 1:
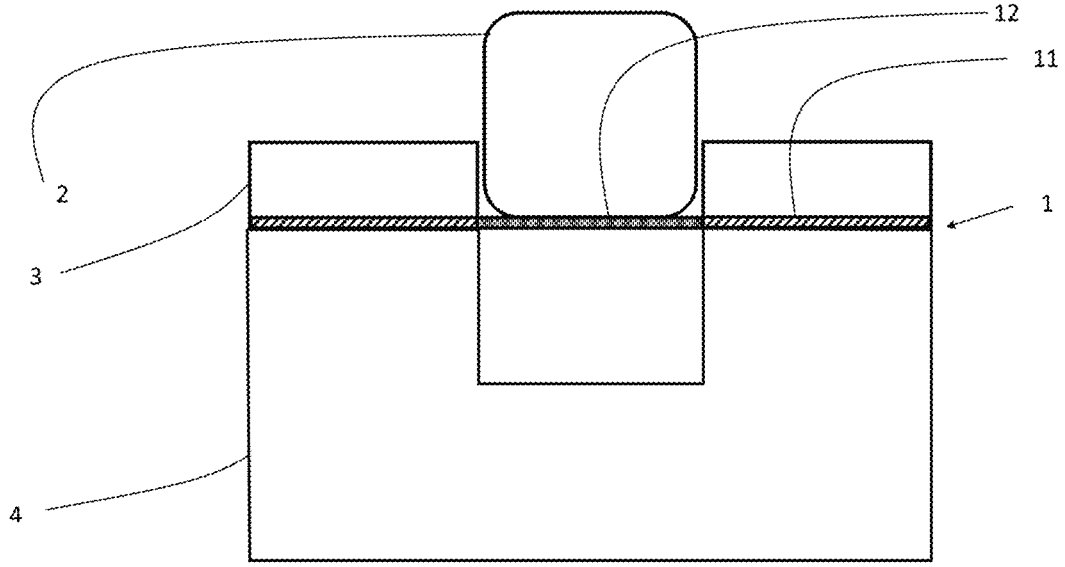
FIG. 1 is a general representation of the stamping process. A blank 1 is hold between a blank holder 3 and a die 4. Two zones of the blank can be distinguished, the flange 11, between the blank holder and the die at the beginning of stamping and the rest of the blank 12 located under the punch 2.

All aluminium alloys referred to in the following are designated using the rules and designations defined by the Aluminum Association in Registration Record Series that it publishes regularly, unless mentioned otherwise.

Metallurgical tempers referred to are designated using the European standard EN-515.

The inventors have found that the formability of cold worked 6xxx aluminium alloy series can be improved without prejudice to their mechanical strength and resistance. The improved properties of these alloys are obtained by carrying out a brief heat treatment on a portion of the flange of the blank, which is also referred to herein as local flash annealing.

According to the invention, a slab is prepared using 6xxx series aluminium alloys.

Particularly preferred aluminium alloy compositions for the invention are AA6016, AA6111, AA6013 and AA6056.

In an embodiment of the invention said 6xxx series aluminium alloy comprise in wt. %, Si: 0.7-1.0; Mg: 1.2-1.6; Cu: up to 0.8; Mn: up to 0.7; Zn up to 1; Fe up to 0.5; Ti: up to 0.15, rest aluminium and unavoidable impurities up to 0.05 and 0.15 total, and preferably Si: 0.7-0.9; Mg: 1.2-1.6; Cu: up to 0.3; Mn up to 0.3; Zn up to 0.05; Fe 0.1-0.4; Ti: 0.01-0.05, rest aluminium and unavoidable impurities up to 0.05 and 0.15 total.

The slab is then optionally homogenised for example at a temperature of about 500° C. typically during 8 hours and preferably at near solidus temperature generally above 550° C., for at least one hour.

Aluminium alloy sheets are obtained by hot rolling the slab to a thickness of typically about 4-10 mm.

An optional cold rolling operation can also be realized directly after the hot rolling step to further reduce the thickness of the aluminium sheets.

The sheet is then solution heat treated and quenched. Preferred conditions are heating at a temperature near solidus temperature typically above 550° C. for about 5 minutes then water quenching.

Cold rolling is then performed to further reduce the aluminium sheets to a lower thickness and increase strength, with at least a 20%, preferably at least 30% and more preferably at least 50% cold work reduction. After the cold rolling operation, the grains of the sheet are fibrous, unrecrystallized. Preferably, the sheet final thickness after this cold rolling operation is 3 mm or less, typically 1.0 to 1.5 mm.

It is advantageous after this last cold rolling step and prior to a cutting step to anneal the sheets at a time and temperature sufficient to obtain an increase of elongation A % in the LT direction of at least 15% and a variation of tensile yield strength in the LT direction less than 15%. Preferably, the increase of elongation A % in the LT direction is at least 20% or even 25%. Typically, this annealing may be carried out by batch treatment at a temperature comprised between 150 and 260° C., preferably between 160 and 190° C. typically for a duration of 5 to 30 mm. However, other conditions are possible if a continuous annealing furnace is available. This operation allows maximizing the elongation without significant evolution of strength.

The sheet is then cut into blanks of desired size and shape.

Figure 2A:
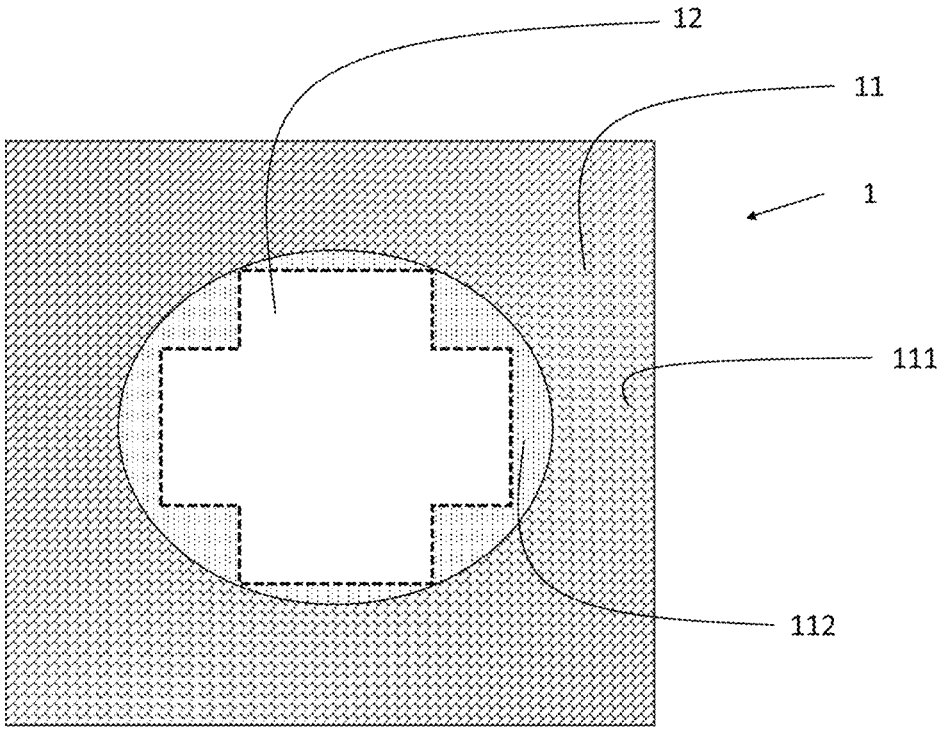
FIGS. 2*a* to 2*d* are top views of a blank 1 illustrating a flange 11 the rest of the blank 12 located under the punch, which is cross-shaped. The flange has a recrystallized portion 111 and an unrecrystallized portion 112.
Figure 2B:
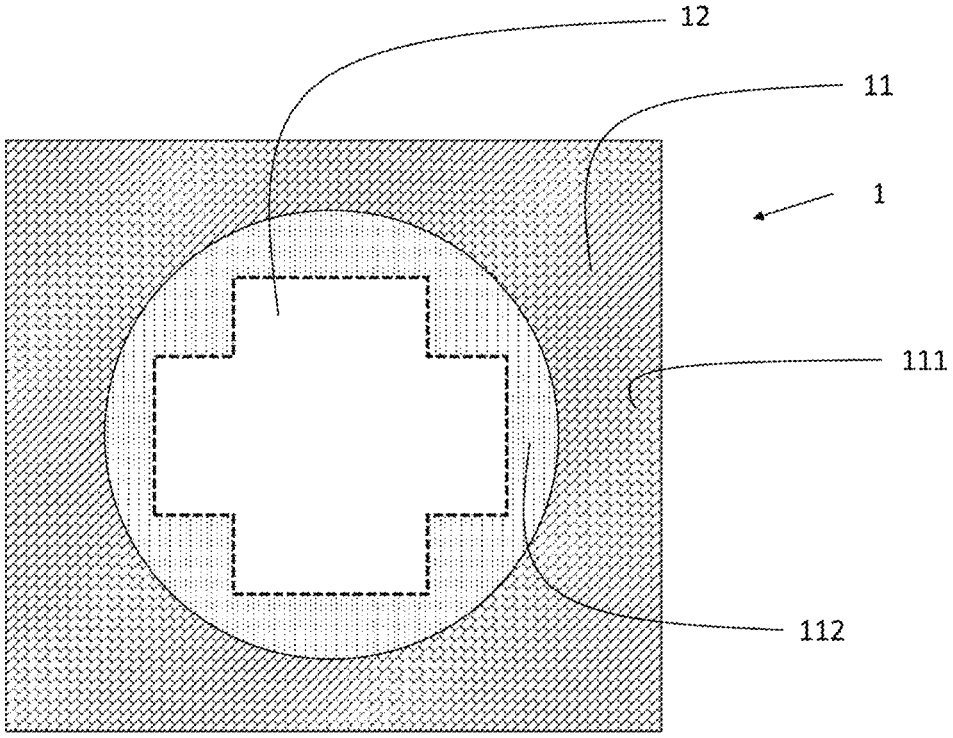
Figure 2C:
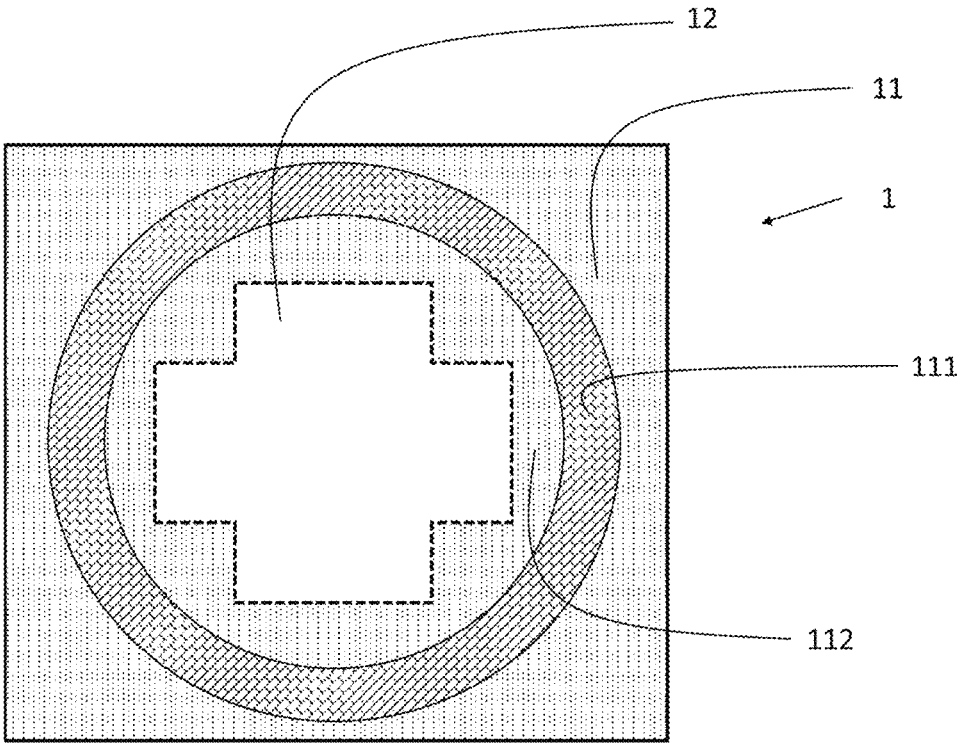
Figure 2D:
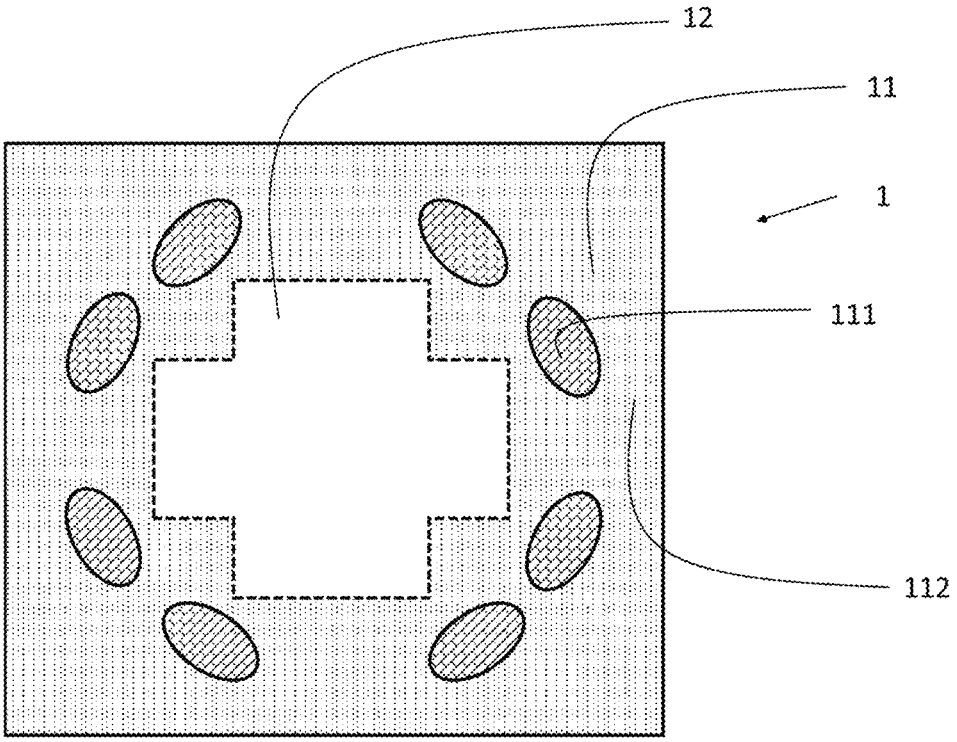

A portion of the flange of the aluminium alloy blanks is then locally flash annealed and cooled, this step consists in a hot and brief heating in order to recrystallize, at least partially, said portion of the flange. Within the present invention, the flange of a blank is the zone of the blank, which is designed to be placed between the blank holder and the die at the beginning of the stamping process. FIG. 1 illustrates a typical stamping process. A blank 1 is hold between a blank holder 3 and a die 4. The flange 11 is located between the blank holder and the die at the beginning of stamping process and the rest of the blank 12 is located under the punch 2. FIGS. 2*a* to 2*d* are top views illustrating example of a blank 1 with a flange 11 the rest of the blank 12 located under the punch, which is cross-shaped in this illustrative example. Two portions of the flange are represented: a recrystallized portion of the flange 111, schematized by bricks, and the rest of the flange 112 schematized by dots. The rest of the flange 112 and the rest of the blank 12 remain essentially unaffected by the flash annealing. At least 25% of the grains of said portion of the flange 111 are recrystallized, preferably at least 50% or even at least 75% of the grains of said portion of the flange are recrystallized. In an embodiment, said recrystallized portion of the flange represents at least 80% of said flange surface as illustrated by FIG. 2*a*. However in other embodiment illustrated for examples by FIGS. 2*c* and 2*d*, only specific locations of the flange, related to the shape of the die, are flash annealed to obtain local recrystallization.

Figure 4:
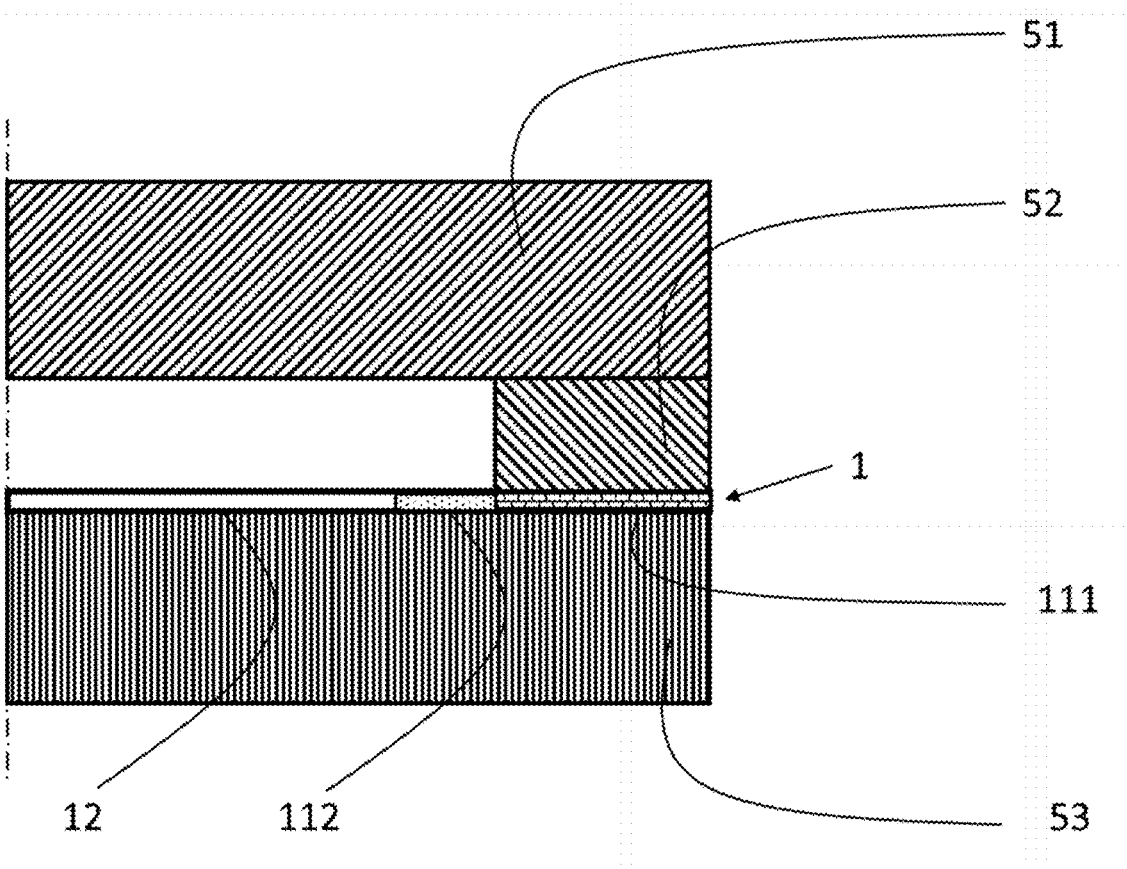
FIG. 4 is a scheme of a device suitable to locally flash anneal a portion of the flange 111 of an aluminium alloy blank 1 according to the invention, with a heating system 51, a heating plate 52 and insulation 53.

FIG. 4 is a scheme of a device suitable to locally flash anneal said portion of the flange of an aluminium alloy blank 1 with a heating system 51, a heating plate 52 and insulation 53. A portion of the flange 111 is in contact with the heating plate to obtain local recrystallization. The flash annealing, typically carried with contact plates 52 which heat locally the blanks, is done so that a portion of the flange is at a temperature between 360° C. and 480° C., preferably between 380° C. and 460° C. and more preferably between 400° C. and 440° C. for a time sufficient to obtain recrystallization, typically at least 5 seconds and sufficiently short to obtain a localized effect typically less than 60 seconds.

The flash annealing conditions may be adjusted to obtain the desired aluminium blank formability properties, for example by using different dimensions and shape for the heating contact plate. Preferably, the flash annealing time is between 10 and 30 seconds. The locally flash annealed blanks are then cooled to a temperature of less than 100° C., preferably artificially cooled. Preferably, the cooling rate is at least 30° C./s and preferentially at least 50° C./s. Artificial cooling may be carried out with forced air flow or with water quenching. A water quenching allows limiting the extent of heating toward the centre of the blanks, which could cause the strength to decrease. The local flash annealing is preferably realised by conduction, by contacting the blank with a heated aluminium plate. In an embodiment, flash annealing of aluminium blanks is obtained by contacting the blank during 20 seconds with a 40 mm wide contact plate heated at 470° C. to obtain a temperature of about 400° C. followed by a water quench.

Flash annealing may be performed once or several times successively. In an embodiment, flash annealing is repeated at least twice, however it is advantageous for productivity to perform the local flash annealing only once. To suit industrial productivity requirements, local flash annealing can be performed by infrared or laser irradiation, induction or conduction.

In an embodiment, the local flash annealing treatment is realized in several operations by contacting the blank during 20 seconds with layout of different widths, for example, three layouts of 20, 30 and 40 mm width contour plates at a temperature of about 470° C. to obtain locally a blank temperature between 400° C. and 420° C. and water quenching after each heating operation. Multiple local flash annealing could allow for more recrystallization within the portion of the flange. A local flash annealing resulting in a local softening of metal under blank holder, pushing back the failure limits such as deeper parts could be achieved. The improved formability and strength balance is particularly suitable for cold work process and usage such as in the automotive industry. The locally recrystallized aluminium blank obtained by the method of the invention can be stored at room temperature for at least a day or even at least a week or more before being stamped without losing its advantageous properties.

The locally flash annealed aluminium blank is then formed into its final shape by stamping and the flange is removed, preferably by cutting, from the rough stamped product such as the stamped product is essentially composed of aluminium of a same metallurgical temper i.e. obtained after cold rolling and optional annealing.

Thus, a stamped aluminium alloy product is obtained by:

placing the flange of a blank according to the invention within the blank holder of a press;

stamping said blank to obtain a rough stamped product;

removing the flange from said rough stamped product.

It should be noted that preferably the blank holder of the press is not heated. The blank is flash annealed in a separate step from the stamping step.

Advantageously, the stamped product is essentially non-recrystallized, with less than 25% of the grains being recrystallized, preferably less than less than 15% of the grains being recrystallized and more preferably less than 5% of the grains being recrystallized.

Optionally the stamped product may pass through an OEM painting line and receive a paint bake heat treatment, typically of 20 min at 180° C.

The stamped product is essentially composed of a homogeneous aluminium alloy that is much stronger, typically with a tensile yield strength in the LT direction at least 25% higher, preferably at least 50% higher and more preferably at least 75% higher than the tensile yield strength in the LT direction measured in T4-temper for a blank of the same alloy obtained by the same process steps a) to f) of the method of the invention. Preferably the tensile yield strength in the LT direction is at least 25% higher, preferably at least 50% higher and more preferably at least 75% higher than the tensile yield strength defined as the minimum Tensile Strength in T4-temper for an alloy registered under the same Aluminium Association number in the "Tempers For Aluminum And Aluminum Alloy Products Edited by The Aluminum Association" (2011).

Preferably, the stamped product has a tensile yield strength in the LT direction of at least 250 MPa, preferably at least 290 MPa and more preferably at least 320 MPa. In an embodiment, a stamped product of the invention is made of alloy AA6016 and has a tensile yield strength of at least 310 MPa.

In an embodiment the stamped product according to the invention has after the painting line, typically after a heat treatment of 20 min at 180° C., a tensile yield strength in the LT direction of at least 290 MPa, preferably at least 350 MPa, more preferably at least 400 MPa, and even more preferably at least 430 MPa.

The stamped aluminium alloy product according to the invention is advantageously used for automotive applications.

Without being linked to any theory, the inventors suppose that the recrystallization induced by a flash local annealing, is suitable to produce a strength gradient in the aluminium sheets plan. This gradient resulting in a better strain distribution by forcing the flange areas to contribute to the forming and releasing critical areas.

EXAMPLES

Example 1

AA6016 aluminium alloy blanks were prepared according to the invention by:

casting an AA6016 aluminium alloy slab having the composition, in weight % of Table 1 below:

TABLE 1

| wt. % | Si | Fe | Cu | Mn | Mg | Cr | Zn | Ti |
|---|---|---|---|---|---|---|---|---|
| 6016 | 1.15 | 0.15 | 0.12 | 0.09 | 0.35 | 0.02 | 0.01 | 0.02 |

homogenizing said aluminium alloy slab;

hot rolling said slab to obtain aluminium alloy sheets of 5.45 mm in thickness;

Solution heat treating and quenching;

cold rolling said sheets to obtain a final thickness of 1.03 mm by applying 2 cold rolling steps of 45% and 66% reduction;

annealing for 5 minutes at 175° C. (A1) or at 200° C. (A2);

cutting to desired size and shape to obtain aluminium alloy blanks;

flash annealing a portion of the flange of the blanks

For comparison purposes, a sample was cold rolled to a thickness of 1 mm and was then solution heat treated, quenched and naturally aged to a T4 temper, it is referred to as 6016-14. A product taken after cold rolling and without any further treatment is referred to as 6016-CW.

Products obtained after cold rolling and with annealing Al or A2 are referred to, respectively, as 6016-CW-Al and 6016-CW-A2. The mechanical properties of some products were measured in the Long Transverse (LT) direction and are presented in Table 2.

TABLE 2

| | Annealing conditions | UTS LT (MPa) | TYS LT (MPa) | A % LT |
|---|---|---|---|---|
| 6016-T4 | | 230 | 115 | 25 |
| 6016-CW-A2 | 5 min at 200° C. | 362 | 332 | 10.7 |

Stamping ability and formability of aluminium alloys were evaluated with an asymmetric cross die test as illustrated in FIG. 2.

Said test consisting in positioning a blank sample of about 1 mm in thickness, maintaining the flange of the blank within a blank holder and measuring the maximum draw depth obtained by applying an asymmetric cross die punch layout of 220 mm×160 mm to the blank using a hydraulic press applying a blank holder pressure of 30 bars to the blank.

The local flash annealing was realised by conduction (FIG. 4), i.e. by contacting, in one or several operations, the blank with a heated plate 52 of 20, 30 or 40 mm contour widths. The temperature of the heating system 51 was set to 470° C., corresponding to a temperature of about 400° C. on the blank. The blank was laying on an insulator 53 having an initial temperature of at most 50° C. The duration was set to 20 seconds per pass. The blank was then water quenched after each pass.

The flash annealing conditions of the portion of the flange of the blanks are provided in Table 3. The width of the flange treated region is provided in mm. Sample 1 was flash annealed three times for 20, 30 and 40 mm contour width, whereas sample 2 was treated once for 30 mm contour width. The portion of the flange was recrystallized, at least partially, after flash annealing for samples 1 to 4.

TABLE 3

| Flash annealing conditions | | | | |
|---|---|---|---|---|
| Sample | Annealed sample | 20 mm | 30 mm | 40 mm |
| Sample 1 | 6016-CW-A1 | X | X | X |
| Sample 2 | 6016-CW-A2 | | X | |
| Sample 3 | 6016-CW-A2 | X | X | |
| Sample 4 | 6016-CW-A2 | | X | X |

Figure 3:
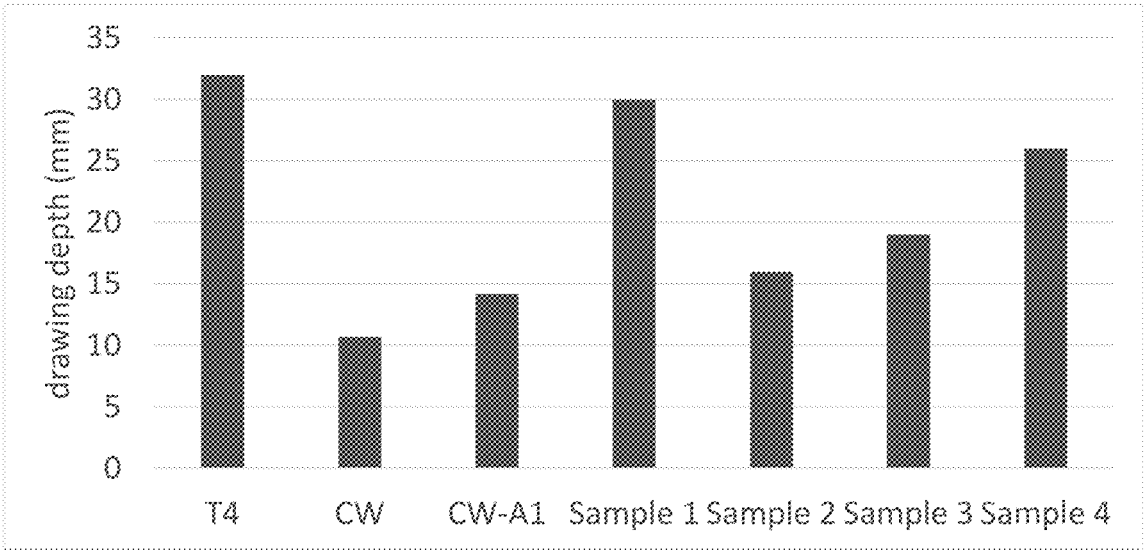
FIG. 3 is a bar chart representing the maximum drawing depth obtained for AA6016 in T4-temper (reference), AA6016 after cold work (CW), AA6016 after annealing (CW-A1) and samples according to the method of the invention (sample 1 to sample 4).

The drawing depth results are provided in FIG. 3.

Cold worked sample (CW), after cold rolling and before annealing, had a poor formability, having a maximum draw depth of about 12 mm. After annealing (CW-A1), the drawing depth was slightly improved to about 15 mm, contributing to a better formability.

All the samples obtained according to the process of the invention exhibited improved drawing ability compared to a sample only annealed such as 6016-CW-A1.

Sample 1 which was obtained by applying 3 local flash annealing heating using 20, 30 and 40 mm width contact plates, exhibited a draw depth ability comparable to the draw depth ability of AA6016-T4.

As the locally flash annealed treated portion is restricted to the flange area and removed and cut from the stamped product, the stamped product is only composed of aluminium alloy of the same metallurgical temper. This proves to be particularly advantageous as it allows achieving a good balance of formability and mechanical resistance.

The method of the invention appears to be an industrially viable process for forming aluminium sheet products of higher formability and strength balance that are generally too complex to stamp using conventional means. The method is thus particularly promising for automotive applications generally requiring a good balance of formability and strength.

Example 2

Two aluminium alloy compositions (1 and 2) according to the invention were cast. These compositions are detailed in Table 4 below, in weight %.

TABLE 4

| weight % | Si | Fe | Cu | Mn | Mg | Zn | Ti |
|---|---|---|---|---|---|---|---|
| Composition 1 | 0.8 | 0.19 | 0.15 | 0.10 | 1.4 | 0 | 0.02 |
| Composition 2 | 0.8 | 0.19 | 0.96 | 0.10 | 1.4 | 0.7 | 0.02 |

The cast ingot were then scalped, homogenized one hour at 580° C. (referred to as 580) or 8 hours at 500° C. (referred to as 500), hot rolled, solution heat treated, quenched and cold rolled to 1.5 mm thickness with either 50% or 75% cold work. The 1.5 mm sheets were annealed at 170° C. during 15 min and cut into blanks.

The anneal conditions were defined by testing different annealing conditions on samples that had been homogenized one hour at 580° C. Heating the blanks at 170° C. for 15 min provided strength and elongation according to the preferred embodiment of the invention with, for 50% cold work, an increase of A % in the LT direction of 33% and a small decrease of tensile yield strength in the LT direction of 2%. The results are provided in table 5.

TABLE 5

| mechanical properties obtained after annealing. | | | | | | | |
|---|---|---|---|---|---|---|---|
| Composition | Cold work | Annealing time | Annealing temperature | TYS LT (MPa) | UTS (MPa) LT | Ag % LT | A % LT |
| 1 | 50% | | | 353 | 405 | 6 | 12 |
| 1 | 50% | 5 min | 170° C. | 343 | 408 | 9 | 16 |
| 1 | 50% | 15 min | 170° C. | 346 | 408 | 10 | 16 |
| 1 | 50% | 5 min | 200° C. | 361 | 408 | 8 | 15 |
| 1 | 50% | 15 min | 200° C. | 379 | 410 | 7 | 13 |
| 1 | 50% | 5 min | 230° C. | 381 | 396 | 4 | 10 |
| 1 | 50% | 15 min | 230° C. | 357 | 374 | 4 | 8 |
| 1 | 50% | 5 min | 260° C. | 379 | 414 | 7 | 12 |
| 1 | 50% | 15 min | 260° C. | 388 | 411 | 6 | 12 |

TABLE 5-continued

| mechanical properties obtained after annealing. | | | | | | | |
|---|---|---|---|---|---|---|---|
| Composition | Cold work | Annealing time | Annealing temperature | TYS LT (MPa) | UTS (MPa) LT | Ag % LT | A % LT |
| 2 | 50% | | | 360 | 432 | 7 | 12 |
| 2 | 50% | 5 min | 170° C. | 356 | 437 | 11 | 15 |
| 2 | 50% | 15 min | 170° C. | 369 | 442 | 11 | 17 |
| 2 | 50% | 5 min | 200° C. | 395 | 444 | 9 | 15 |
| 2 | 50% | 15 min | 200° C. | 423 | 457 | 6 | 12 |
| 2 | 50% | 5 min | 230° C. | 426 | 453 | 5 | 10 |
| 2 | 50% | 15 min | 230° C. | 420 | 443 | 4 | 9 |
| 2 | 50% | 5 min | 260° C. | 427 | 463 | 7 | 12 |
| 2 | 50% | 15 min | 260° C. | 435 | 463 | 5 | 11 |
| 1 | 75% | 5 min | 170° C. | 373 | 422 | 7 | 8 |
| 1 | 75% | 15 min | 170° C. | 377 | 426 | 8 | 11 |
| 1 | 75% | 5 min | 200° C. | 383 | 419 | 7 | 10 |
| 1 | 75% | 15 min | 200° C. | 397 | 423 | 6 | 8 |
| 1 | 75% | 15 min | 230° C. | 365 | 377 | 3 | 5 |
| 1 | 75% | 5 min | 260° C. | 337 | 353 | 4 | 6 |
| 1 | 75% | 15 min | 260° C. | 307 | 329 | 4 | 5 |
| 2 | 75% | 5 min | 170° C. | 395 | 456 | 9 | 11 |
| 2 | 75% | 15 min | 170° C. | 409 | 474 | 9 | 11 |
| 2 | 75% | 5 min | 200° C. | 432 | 475 | 7 | 10 |

The blanks were locally flash annealed on a portion of the flange in order to soften the flange area placed within the die during a stamping process. The local flash annealing was realised by conduction, using an aluminium contact plates heated at about 450° C. to obtain a local blank temperature of about 400° C.

The flash annealing was done in one or three steps using the conditions described below:

#1: 1 step: using a layout of 40 mm wide during 20 s followed by a water quench.

#3: 3 steps: using layouts of 20, 30 and 40 mm widths during 20 seconds each and water quench after each step.

#0: A reference sample, which received 50% cold work, had no local flash annealing.

The hardness property of the blanks was measured using a Vickers device using a 5 kg weight.

These measurements allow characterising the property gradient of the blank before stamping.

Figure 5:
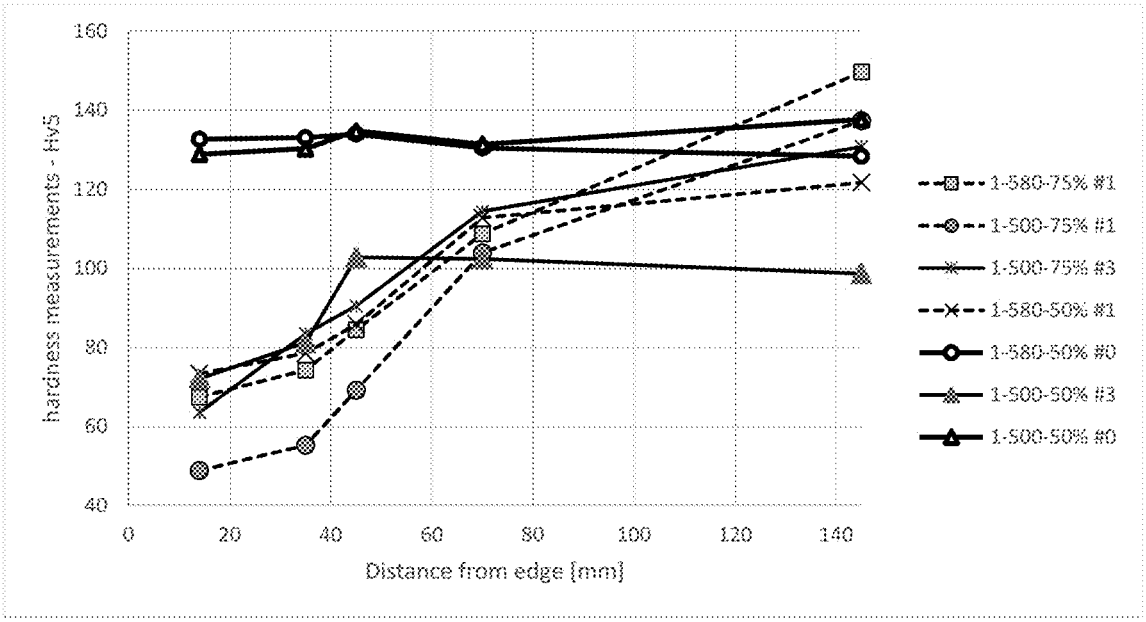
FIG. 5 is a graph representing the hardness measurement across the flash annealed blanks of composition 1 in example 2.
Figure 6:
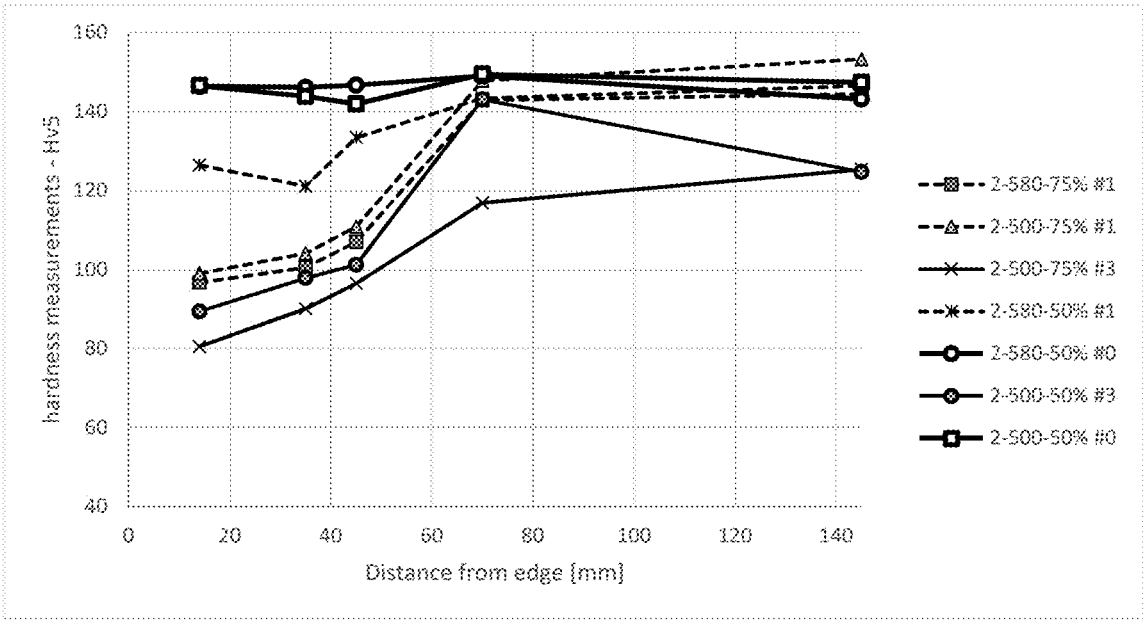
FIG. 6 is a graph representing the hardness measurement across the flash annealed blanks of composition 2 in example 2.

It was possible to obtain a clear and well-defined property gradient after a short heat treatment (FIG. 5 and FIG. 6) characterised by a hard and unmodified centre portion and soft recrystallized portion of the flange. On FIGS. 5 and 6, the samples are referred to as follows: composition-homogenizing-cold work-flash annealing.

These measurements thus demonstrate that a local flash annealing according to the invention is suitable to control the property gradient of the blank by recrystallizing, at least partially, the portion of the flange of the blank.

The formability was measured using a cross die test. Two types of blanks were used:

big blanks: oval blank 320×290 mm×mm small blanks: oval blank 280×250 mm×mm (heating area: 20 mm wide instead of 40 mm)

Figure 7:
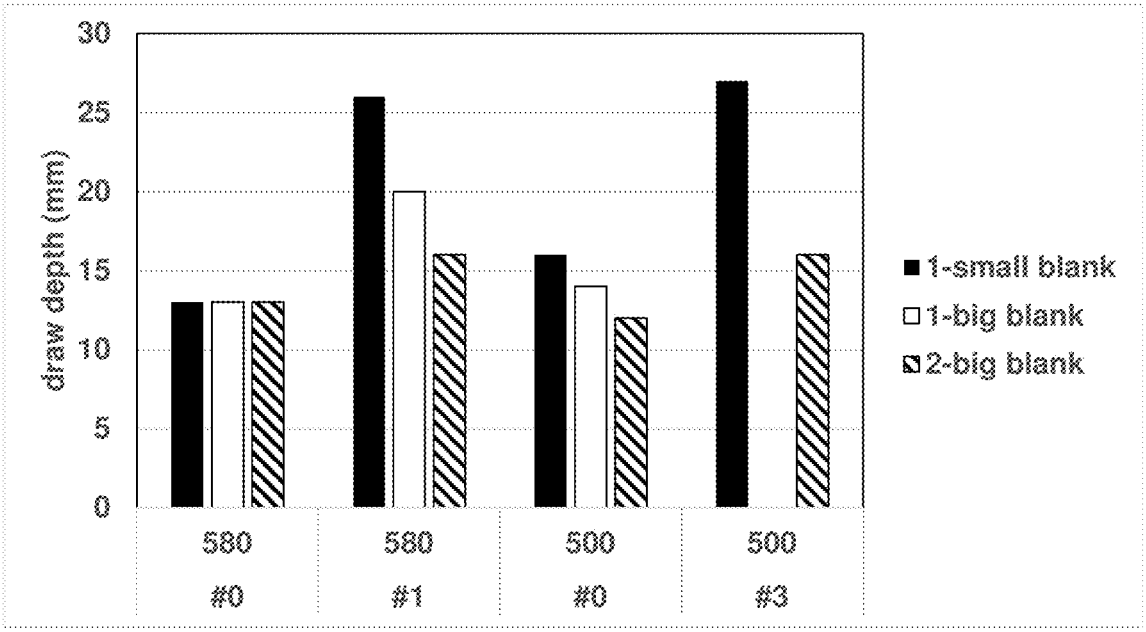
FIG. 7 is a bar chart representing the maximum draw depth in mm obtained for compositions 1 and 2 with 50% cold work according to the invention.

The maximum draw depth of Composition 1 with homogenizing at 580° C. and 50% cold work improves from 12 mm up to 25 mm after local flash annealing (FIG. 7).

Even if the maximum draw depth obtained is lower than e.g. AA6016-T4 aluminium alloy, the measured mechanical strength (TYS>200 MPa) is much higher and results in a much stronger product, which can eventually be down gauge to achieve a lighter product.

Several sample further received thermal treatment of 20 min at 180° C. to simulate a paint bake treatment. Samples from the center portion of the blanks were mechanically tested. The results are provided in Table 6.

TABLE 6

| Mechanical properties after paint bake simulation | | | | | | |
|---|---|---|---|---|---|---|
| Composition | Cold work | Annealing time | Annealing temperature | Flash annealing | TYS (Mpa) LT | UTS (MPa) LT |
| 1 | 50% | 15 min | 170° C. | # 1 | 420 | 422 |
| 1 | 75% | 15 min | 170° C. | # 3 | 299 | 318 |
| 2 | 50% | 15 min | 170° C. | # 1 | 443 | 451 |
| 2 | 50% | 15 min | 170° C. | # 3 | 425 | 427 |
| 2 | 75% | 15 min | 170° C. | # 1 | 442 | 465 |
| 2 | 75% | 15 min | 170° C. | # 3 | 338 | 363 |

The invention claimed is:

1. A method for improving aluminium alloy blank tensile yield stress and formability comprising successively:

rolling a 6xxx series aluminium alloy slab to form a sheet, wherein the rolling comprises hot rolling or a combination of hot and cold rolling;

performing solution heat treating and quenching of the sheet;

cold rolling the sheet with at least 20% cold work reduction;

cutting the sheet to form a blank, the blank comprising:

a flange configured to be held by a blank holder of a press, the flange comprising a first region and a second region, and a target configured to receive a punch of the press;

flash annealing the first region, wherein the flash annealing comprises:

heating the first region at a temperature between 360° C. and 440° C. for 5 to 60 seconds to recrystallize the first region, and cooling, subsequent to the heating, the first region to a temperature of less than 100° C., wherein the flash annealing is localized to the first region;

maintaining the blank at room temperature for at least a day subsequent to the flash annealing;

placing the flange of the blank within the blank holder of the press;

stamping the target with the punch of the press subsequent to the maintaining of the blank at room temperature to form a stamped product; and removing the flange from the stamped product to form an excised product, wherein the excised product is essentially non-recrystallized.

2. The method of claim 1 wherein after the cold rolling with at least 20% cold work reduction and prior to the cutting, the sheet is annealed at a time and temperature sufficient to obtain an increase of elongation A % in a LT direction of at least 15% and a variation of tensile yield strength in the LT direction less than 15%.

3. The method according to claim 1 wherein the cold rolling with at least 20% cold work reduction is performed with at least 30% cold work reduction.

4. The method according to claim 1 wherein the sheet final thickness is 3 mm or less upon the cutting.

5. The method according to claim 1 wherein the cooling to a temperature of less than 100° C. of the flash annealing is performed at a cooling rate of at least 30° C./s.

6. The method according to claim 1 wherein flash annealing is repeated at least twice.

7. The method according to claim 1 wherein the 6xxx series aluminium alloy is selected from the group consisting of AA6016, and AA6056.

8. The method according to claim 1 wherein said 6xxx series aluminium alloy comprises in wt. %, Si: 0.7-1.0; Mg: 1.2-1.6; Cu: up to 0.8; Mn: up to 0.7; Zn up to 1; Fe up to 0.5; Ti: up to 0.15, rest aluminium and unavoidable impurities up to 0.05 individually and 0.15 in total.

9. The method according to claim 1, wherein the excised product has a tensile yield strength in the LT direction of at least 250 MPa.

10. The method according to claim 1, wherein a painted product formed from the excised product by a paint bake treatment of 20 minutes at 180° C. has a tensile yield strength in the LT direction of at least 290 MPa.

11. The method according to claim 1, wherein the excised product is configured for an automotive application.

12. The method according to claim 1 wherein the cold rolling with at least 20% cold work reduction is performed with at least 50% cold work reduction.

13. The method according to claim 1 wherein said 6xxx series aluminium alloy comprises in wt. %, Si: 0.7-0.9; Mg: 1.2-1.6; Cu: up to 0.3; Mn up to 0.3; Zn up to 0.05; Fe 0.1-0.4; Ti: 0.01-0.05, rest aluminium and unavoidable impurities up to 0.05 individually and 0.15 in total.

14. The method according to claim 1, wherein the excised product has a tensile yield strength in the LT direction of at least 320 MPa.

15. The method according to claim 2, wherein after the cold rolling with at least 20% cold work reduction and prior to cutting, the sheet is annealed at a temperature between 160 and 190° C. for 5-30 minutes.

16. The method according to claim 1, wherein the flash annealing the temperature of the flash annealing is between 400° C. and 440° C.

17. The method of claim 1, wherein the blank is maintained at room temperature for at least a week subsequent to the flash annealing.

18. The method according to claim 1 wherein the 6xxx series aluminium alloy is selected from the group consisting of AA6111 and AA6013.

19. The method according to claim 1 wherein there is no artificial aging of the sheet prior to stamping and after solution heat treatment.

* * * * *